US008927111B2

(12) United States Patent
Ikeda et al.

(10) Patent No.: US 8,927,111 B2
(45) Date of Patent: Jan. 6, 2015

(54) SURFACE COATING MATERIAL FOR MOLTEN ZINC BATH MEMBER, PRODUCTION METHOD THEREOF, AND MOLTEN ZINC BATH MEMBER

(75) Inventors: Hiroki Ikeda, Himeji (JP); Katsu Yanagimoto, Himeji (JP)

(73) Assignee: Sanyo Special Steel Co., Ltd., Himeji-shi, Hyogo-ken (JP)

( * ) Notice: Subject to any disclaimer, the term of this patent is extended or adjusted under 35 U.S.C. 154(b) by 1060 days.

(21) Appl. No.: 12/594,046

(22) PCT Filed: Apr. 4, 2008

(86) PCT No.: PCT/JP2008/056792
§ 371 (c)(1),
(2), (4) Date: Sep. 30, 2009

(87) PCT Pub. No.: WO2008/126794
PCT Pub. Date: Oct. 23, 2008

(65) Prior Publication Data

US 2010/0075133 A1 Mar. 25, 2010

(30) Foreign Application Priority Data

| | | |
|---|---|---|
| Apr. 6, 2007 | (JP) | 2007-100251 |
| May 7, 2007 | (JP) | 2007-122643 |
| Mar. 7, 2008 | (JP) | 2008-057301 |

(51) Int. Cl.

| | |
|---|---|
| ***B22F 7/00*** | (2006.01) |
| ***B32B 9/00*** | (2006.01) |
| ***C23C 4/06*** | (2006.01) |
| ***C22C 1/05*** | (2006.01) |
| ***C22C 19/07*** | (2006.01) |
| ***C23C 4/04*** | (2006.01) |
| ***C22C 29/08*** | (2006.01) |
| ***C23C 2/00*** | (2006.01) |

(52) U.S. Cl.
CPC . *C23C 4/04* (2013.01); *C22C 29/08* (2013.01); *C23C 2/003* (2013.01); *C23C 4/06* (2013.01)
USPC ..... 428/551; 428/698; 427/451; 420/435; 419/14

(58) Field of Classification Search
None
See application file for complete search history.

(56) References Cited

U.S. PATENT DOCUMENTS 5,395,661 A * 3/1995 Mizunuma et al. ..... 427/451
5,472,793 A 12/1995 Harada et al.

(Continued)

FOREIGN PATENT DOCUMENTS

CN 1174247 A 2/1998
EP 0569585 A1 11/1993

(Continued)

OTHER PUBLICATIONS

Wang, "Post treatment of Plasma Sprayed WC-Co-Ni Coating by High Frequency Induction Heating",Guowai J Inshu Rechuli, Jun. 2003, pp. 27-29, vol. 24 No. 3, China.

(Continued)

*Primary Examiner* — Michele L Jacobson
*Assistant Examiner* — Seth Dumbris
(74) *Attorney, Agent, or Firm* — The Webb Law Firm

(57) ABSTRACT

There are provided a surface coating material for a molten zinc bath member with improved zinc corrosion resistance, a production method thereof, and a molten zinc bath member. The surface coating material comprises WC powder particles and a binder metal. The binder metal comprises Co and a metal element electrochemically nobler than Co and constitutes an alloy structure having a single phase.

6 Claims, 2 Drawing Sheets

(56) References Cited

U.S. PATENT DOCUMENTS

| | | | | | |
|---|---|---|---|---|---|
| 5,993,978 | A | * | 11/1999 | Kim et al. | 428/553 |
| 6,037,287 | A | * | 3/2000 | Fukubayashi | 501/87 |
| 6,284,062 | B1 | * | 9/2001 | Nagashima et al. | 148/318 |
| 2007/0087205 | A1 | * | 4/2007 | Jarosinski et al. | 428/446 |
| 2007/0243335 | A1 | * | 10/2007 | Belashchenko | 427/451 |
| 2010/0047622 | A1 | * | 2/2010 | Fischer et al. | 428/698 |

FOREIGN PATENT DOCUMENTS

| | | | | |
|---|---|---|---|---|
| EP | 0687746 | | * 12/1995 | |
| JP | 60103169 | | 6/1985 | |
| JP | 04358055 | A | 12/1992 | |
| JP | 09013161 | | 1/1997 | |
| JP | 09025583 | | 1/1997 | |
| JP | 2000219953 | | 8/2000 | |
| JP | 2004331995 | | 11/2004 | |
| JP | 2006-328496 | | * 6/2006 | C23C 4/04 |
| JP | 2006328496 | | 12/2006 | |
| JP | 3080651 | B2 | 8/2008 | |
| KR | 20030053780 | A | 7/2003 | |
| WO | 2007/047330 | A1 | 4/2007 | |

OTHER PUBLICATIONS

Tomita et al., Durability of WC/Co Sprayed Coatings in Molten Pure Zinc, Iron and Steel, the Iron and Steel Institute of Japan, Apr. 1, 1992, pp. 100-106, vol. 78, No. 4 (English-language Abstract attached).

* cited by examiner

SURFACE COATING MATERIAL FOR MOLTEN ZINC BATH MEMBER, PRODUCTION METHOD THEREOF, AND MOLTEN ZINC BATH MEMBER

TECHNICAL FIELD

The present invention relates to a surface coating material for a molten zinc bath member with an excellent zinc corrosion resistance, a production method thereof, and a molten zinc bath member.

BACKGROUND ART

A hot dip galvanized steel sheet is generally utilized as a steel sheet for automobiles, a material for civil engineering and architecture, or a heat resistant or corrosion resistant material for home electric appliances, and so on. Most of such hot dip galvanized steel sheets are produced mainly by continuous molten zinc galvanizing treatment. Apparatuses used for such continuous molten galvanizing treatment are provided with a dip roll immersed in the molten zinc, rolls disposed near the molten zinc surface, guide rolls for guiding the galvanized steel sheet after passing these rolls, etc. In addition, an injection nozzle, which blows a high pressure nitrogen gas along the steel sheet passing above the galvanizing bath, is equipped on the apparatus in order to control the amount of molten zinc which adheres to the steel sheet which is pulled up from the molten zinc.

These rolls and the injection nozzle are immersed in the molten zinc, are subjected to adherence of the scattered molten zinc, or are contacted with a highly-heated steel sheet coated with molten zinc. Especially, a sink roll for the zinc galvanizing bath, which is one of the major equipments for the hot dip galvanized steel sheet, has a problem that the sink roll degrades due to corrosion by reacting with the molten zinc and to adherence of intermetal compounds and the degraded part adversely affects the quality of the zinc galvanized steel sheet as a product.

In order to address this problem, Japanese Patent Laid-Open Publication No. H9-25583 proposes a ceramics-coated roll for molten zinc bath, in which the surface of the roll has been thermally sprayed with a carbide containing 85% by weight or more of WC, followed by surface coating with a ceramic film comprising at least one of the nitrides or carbonitrides of Ti, Al, Hf, or Zr.

In addition, Japanese Patent Laid-Open Publication No. 2004-331995 proposes a surface coating material for an immersion member of a molten metal galvanizing bath, in which 50 to 90% by mass of a ceramics powder comprising one or more of oxide, nitride, carbide, boride, or silicide is dispersed in a powder of one, or an alloy powder of two or more, selected from Ta, Ti, V, Mo, Cr, Zr, Nb, Hf, or W, which is a high melting-point metal powder having a melting point higher than that of Co.

The surfaces of the rolls proposed in the aforementioned Japanese Patent Laid-Open Publication No. H9-25583 and No. 2004-331995, generally referred to as a sink roll, is treated with thermal spraying with a cermet comprising tungsten carbide (hereinafter referred to as "WC") and Co (hereinafter referred to as "WC/Co cermet"), in order to improve the zinc corrosion resistance while retaining the abrasion resistance. However, the zinc corrosion resistance is not sufficient and the degradation of the roll surface may cause the defect of the product. Especially in recent years, due to the strict quality requirements for the steel sheets for automobiles, even the materials disclosed in Japanese Patent Laid-Open Publication No. H9-25583 or No. 2004-331995 and WC/Co cermet thermal sprayed materials require maintenance at least about every month. It is therefore the current situation that further improvement in zinc corrosion resistance is required. In addition, Japanese Patent Laid-Open Publication No. H9-25583 has a problem that cost and processing time are increased for performing two types of thermal sprayings. Japanese Patent Laid-Open Publication No. 2004-331995 has a problem that the thermal spraying process condition is restricted for melting and scattering the high melting-point metal.

SUMMARY OF THE INVENTION

Thermal spray coating is generally performed using a cermet powder prepared by mixing a WC powder with a binder metal powder followed by granulating the mixture to about 50 μm or less. Therefore, in order to solve the aforementioned problems and to develop the thermal spraying powder having good zinc corrosion resistance, the present inventors performed basic studies on the factors influencing the zinc corrosion resistance through a research of corrosion characteristics in molten zinc for Co-base alloys which have a good compatibility with WC, regarding the corrosion characteristics of the conventional WC/Co cermet material, focusing attention on the binder metal of the cermet.

As a result, the present inventors has found that the corrosion phenomenon of the WC/Co thermal spray film was resulted not only from the surface degradation due to the elution of Co by mutual diffusion reaction with molten zinc, but also from the release of film component to the molten metal due to the local cell action generated between WC and the binder metal or among the binder metals themselves, when immersed in the molten metal. That is, the present inventors have found that the surface coating material fora molten zinc bath member with an improved zinc corrosion resistance, the production method thereof, and the molten zinc bath member can be provided by alloy designing so that the binder metal of the WC/Co cermet has a uniform structure and a nobler potential than Co in order to suppress the local cell action when immersed in the molten zinc. According to the present invention, it is possible to form a thermal spray film excellent in zinc corrosion resistance and to increase the lifetime of the sink roll and the like by decreasing the local cell action with WC.

It is therefore an object of the present invention to provide a surface coating material for a molten zinc bath member with improved zinc corrosion resistance, a production method thereof, and a molten zinc bath member.

According to the present invention, there is provided a surface coating material for forming a coated layer on a surface of a molten zinc bath member, wherein the surface coating material comprises WC powder particles and a binder metal, and wherein the binder metal comprises Co and a metal element electrochemically nobler than Co and constitutes an alloy structure having a single phase.

According to a preferred embodiment of the present invention, it is preferable that the binder metal is an alloy comprising Co and one or more of Ni, Al, Si, Mo, Nb, Cr, W, and Ta.

According to a preferred embodiment of the present invention, it is preferable that the binder metal constitutes an alloy containing 10 to 75% by mass of Ni relative to the total amount of the binder metal in addition to Co.

According to a preferred embodiment of the present invention, it is preferable that the binder metal comprises one or more of 23 to 35% by mass of Al, 0.2 to 6.0% by mass of Si, 0.2 to 15% by mass of Mo, 0.2 to 11% by mass of Nb, 0.2 to 11% by mass of Cr, 0.2 to 20% by mass of W, and 0.2 to 5% by mass of Ta relative to the total amount of the binder metal in addition to Co.

According to a preferred embodiment of the present invention, it is preferable that the blending ratio of the binder metal to the WC powder particles be 5 to 25% by mass.

According to a preferred embodiment of the present invention, it is preferable that the immersion potential of the binder metal in the aqueous environment or molten metal environment is 50 mV or more nobler than Co.

According to a preferred embodiment of the present invention, it is preferable that the binder metal is provided in a form of alloy powder comprising Co and one or more of Ni, Al, Si, Mo, Nb, Cr, W, and Ta and that the alloy powder is mixed with the WC powder and granulated.

According to a preferred embodiment of the present invention, it is preferable that the binder metal is provided in a form of alloy powder containing 10 to 75% by mass of Ni relative to the total amount of the binder metal in addition to Co and that the alloy powder is mixed with the WC powder and granulated to a powder having a particle diameter of 5 μm or more and 75 μm or less.

According to a further preferred embodiment of the present invention, it is preferable that the coated layer is formed on a circumferential surface using the surface coating powder and have a thickness of 20 μm or more and 1200 μm or less.

According to the present invention, there is also provided a surface-coated molten zinc bath member comprising:

a molten zinc bath member; and a coated layer provided on a surface of the molten zinc bath member, the coated layer being made of the surface coating material according to the present invention.

According to the present invention, there is also provided a method for producing a surface coating material for forming a coated layer on a surface of a molten zinc bath member comprising the steps of:

producing an alloy powder comprising one or more of Ni, Mo, Si, Nb, Al, Cr, W, and Ta in addition to Co, by an atomization method or by a method of pulverizing a quenched thin strip or an alloy in a thin-strip or mass form obtained by casting;

mixing the alloy powder with a WC powder to form a mixed powder; and granulating the mixed powder to obtain the surface coating material.

According to a preferred embodiment of the present invention, it is preferable that the alloy powder contains 10 to 75% by mass of Ni in addition to Co and that the granulation is performed to provide the mixed powder with a particle diameter of 5 μm or more and 75 μm or less According to a preferred embodiment of the present invention, there is provided a method for producing a molten zinc bath member, comprising thermal spraying the surface of the molten zinc bath member with the surface coating material to obtain a surface-coated molten zinc bath member.

DETAILED DESCRIPTION OF THE INVENTION

The present invention will be explained in detail below with reference to the drawings.

As mentioned above, as a result of the research on the corrosion characteristics of WC/Co cermet material, a basic study was performed on the factors influencing the zinc corrosion resistance through a research of corrosion characteristics in molten zinc for Co base alloy which has a good compatibility with WC, focusing attention on the binder metal of the cermet. As a result, it was found that the WC/Co thermal spray film was influenced not only by the surface degradation due to the elution of Co by mutual diffusion reaction with molten zinc, but also by the electrochemical release due to the so-called local cell action.

For example, it was found that the zinc corrosion resistance in the case where two or more kinds of metals and the like contacted with each other could not be explained merely by the diffusion constant, and that the local cell action due to the contact of different kinds (an electrochemical action due to the potential difference) is contributory. Therefore, when a circuit is formed by immersing WC and Co in molten zinc, an electric current is generated by ionization of Co due to the local cell action. In addition, it was found that the electric current density generated varies depending on the area ratio between the corroded anode and the counter cathode.

In view of the above, it was revealed that the electrochemical action due to the local cell affected the corrosion resistance. In order to prevent this phenomenon, the binder metal should be electrochemically more stable than the currently used Co, preferably almost as stable as WC. This enables suppression of the local cell action between WC and the binder metal and the local cell action within the binder metal, resulting in an improvement in zinc corrosion resistance. Based on this consideration, the inventors studied at obtaining a thermal spray coating material having good zinc corrosion resistance by improving the binder metal. First, improvement in zinc corrosion resistance was investigated by the addition of an alloy to Co base, considering the compatibility with WC.

When the zinc corrosion resistance of WC with 12% by mass Co, which is the conventional thermal spray layer, was investigated by the molten zinc immersion test (470° C.), it was revealed that deficit in WC occurred due to the Co corrosion into the molten zinc. Therefore, since prevention of corrosion of Co, which is the binder metal, is important for the improvement in the zinc corrosion resistance, the alloy designing was performed aiming at making the binder metal of WC/Co cermet have a uniform structure and a noble potential in order to suppress the local cell action, based on the aforementioned consideration.

Figure 1:
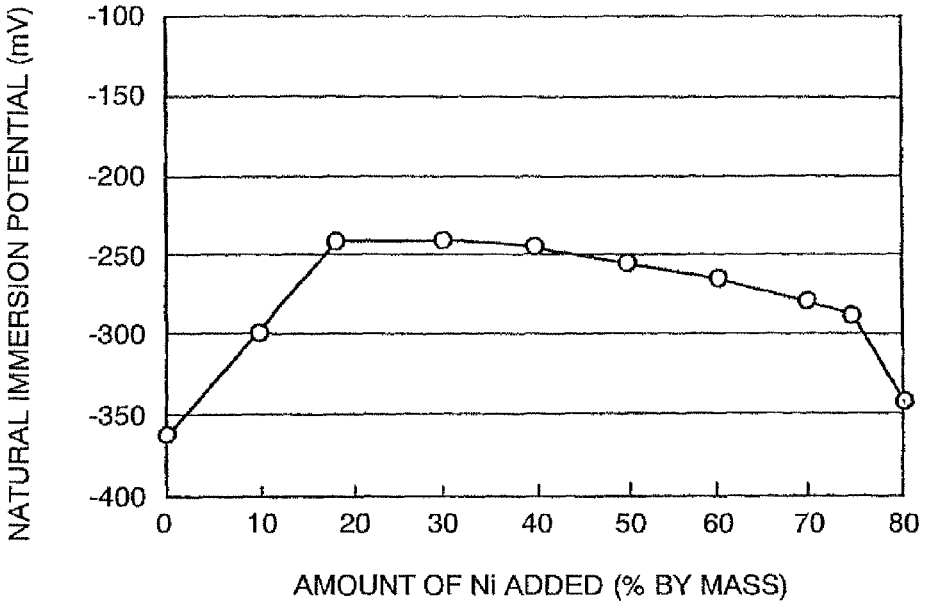
FIG. 1 is a graph showing an effect of addition of Ni to Co on the immersion potential in 1% by volume sulfuric acid retained at 30° C.

First, Ni was added to Co as an element to increase the potential in a nobler direction. As a result, it was found that the addition of Ni to Co exhibited a single-phase structure and that no eutectic structure and the like were present. FIG. 1 shows the influence of the addition of Ni to Co on the immersion potential in 1% by volume sulfuric acid retained at 30° C. The horizontal axis shows the amount of Ni added (% by mass) and the vertical axis shows the natural immersion potential in the corresponding solution to the saturated calomel electrode as the reference electrode (mV vs SCE). As shown in this figure, the natural immersion potential is −300 mV at 10% by mass Ni, being 50 mV or more higher than Co (−350 mV). It is shown that the improvement is attained by addition of Ni, although this tendency levels off at 18 Ni or more.

Figure 2:
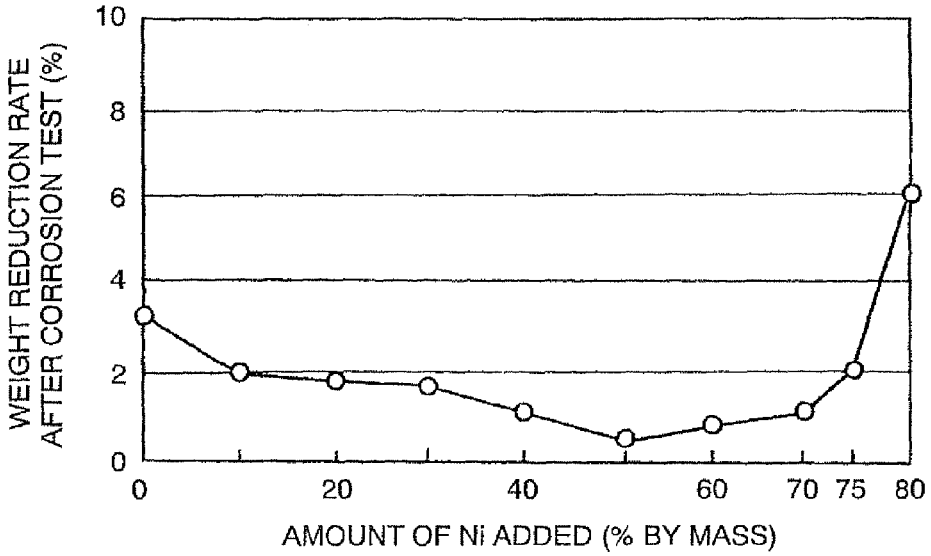
FIG. 2 is a graph showing an effect of addition of Ni to Co on zinc corrosion rate.

FIG. 2 shows the influence of the addition of Ni to Co on the zinc corrosion rate. As shown in this figure, the horizontal axis shows the amount of Ni added (% by mass) and the vertical axis shows the weight decrease rate after the corrosion test (% by mass). As shown in this figure, an improvement in zinc corrosion resistance was observed with Co-10Ni, and it was found that the improvement is fully attained with Co-50Ni. Therefore, in the present invention, it is preferable that the alloyed powder containing 10 to 75% by mass of metal Ni in Co is mixed with and dispersed in the cermet powder WC for thermal spray.

In this case, if each of Co and Ni is mixed and sintered, Co and Ni in the binder metal are not completely alloyed and do not give a uniform structure, although the total weight becomes the aimed value. Therefore, it is desirable that the powder completely alloyed beforehand is used and is mixed with and dispersed in WC. According to a preferred embodiment of the present invention, the range of the amount of Ni to be added is 10 to 75% by mass, preferably 25 to 60% by mass, relative to the total amount of the binder metal. If Ni is less than 10% by mass, the zinc corrosion resistance may be insufficient because of the insufficient potential increase effect. If Ni is more than 75% by mass, the zinc corrosion resistance may be rather degraded, since the natural immersion potential levels off and the structure is closer to Ni single phase.

The addition of Al, Si, Mo, Nb, Cr, W, Ta, etc. is fundamentally based on the aforementioned consideration. However, when these metals are added, the alloy structure obtained varies depending on the amount to be added and the uniform structure may not necessarily be obtained. Therefore, the amount to be added is limited so that the uniform structure is formed and is further limited so that the potential increases in a nobler direction than Co.

According to a preferred embodiment of the present invention, the range of the amount to be added in addition to Co, relative to the total amount of the binder metal is:

Al: 23 to 35% by mass, preferably 23 to 30%, more preferably 25 to 30%;

Si: 0.2 to 6.0% by mass, preferably 0.2 to 4.5%, more preferably 0.2 to 3.0%;

Mo: 0.2 to 15% by mass, preferably 0.2 to 12%, more preferably 0.2 to 10%;

Nb: 0.2 to 1.5% by mass, preferably 0.2 to 1.0%, more preferably 0.2 to 0.8%;

Cr: 0.2 to 11% by mass, preferably 0.2 to 10%, more preferably 0.5 to 8%;

W: 0.2 to 20% by mass, preferably 0.2 to 15%, more preferably 0.2 to 10%; and

Ta: 0.2 to 5% by mass, preferably 0.2 to 3%, more preferably 0.5 to 3%.

If the amount to be added is too small, improvement in zinc corrosion resistance is insufficient because of the insufficient potential increase effect. In addition, if the amount to be added is too large exceeding the aforementioned limit, the zinc corrosion resistance degrades, since the structure of the binder metal is not uniform and the local cell action occurs within the binder metal.

According to a preferred embodiment of the present invention, the aforementioned cermet powder for thermal spraying is produced by making the alloy powder containing Co and the added metal by a method of atomization, a method of making quenched thin strip or a casting method, followed by a pulverizing step of preparing fine powder, mixing with the WC powder, and granulation. By thermal spray coating of the surface of the molten zinc bath member using this thermal spray cermet powder, the thermal spray coating film with WC particles dispersed is formed on the surface of the molten zinc bath member. As a result, the zinc corrosion resistance was improved because the improved alloy having a nobler potential than Co decreases the local cell action with WC.

According to a preferred embodiment of the present invention, as the raw material powder for granulation, fine powder of WC of 1 to μm and the binder alloy powder of 1 to 5 μm are generally used. Therefore, it is preferable that the alloy produced by either atomization, thin strip method, or casting is treated with a cutting and pulverizing machine to pulverize to 5 μm or less. WC fine powder and the binder alloy powder are mixed and the resultant mixture powder is granulated. In this case, the blending ratio of the binder alloy to WC is preferably 5 to 25% by mass, more preferably 5 to 18% by mass, and further more preferably 8 to 18% by mass. If the blending ratio of the alloy is too low, the binder effect is insufficient and the film property degrades due to insufficient fixing of WC. In addition, if the blending ratio is too high, the film strength after thermal spraying is insufficient, resulting in deterioration of abrasion resistance and the like, which is inappropriate for a roll member. Preferred particle diameter of the spherical powder obtained by granulation is 5 to 75 μm, more preferably 10 to 60 μm, and further more preferably 15 to 55 μm.

According to a preferred embodiment of the present invention, the resultant powder is used for thermal spraying using high-velocity flame spraying method which is being used for the conventional WC/Co cermet thermal spraying. This thermal spray film is about 20 to 1200 μm thick, usually about 100 to 1000 μm thick. Thermal spraying of less than 20 μm is difficult and does not provide sufficient dispersion of WC and the binder metal to secure the characteristics. If the thickness exceeds 1200 μm, the thermal spray film is so thick that it tends to cause crack and detachment at cooling. In addition, it is possible to make the coated film thinner than the conventional WC/Co cermet thermal spraying, since the present invention provides a good zinc corrosion resistance. Further, although the size of the roll to be used may vary depending on the apparatus, the diameter of about 50 mm to about 700 mm may be generally used.

Atomization method to produce each powder includes gas atomization method and water atomization method in which molten metal is segmented by gas injection or water spraying, respectively. Although the powder producing method is not particularly limited, gas atomization method is preferable because the oxygen amount on the powder surface is small. Thin strip method is a method for producing a quench-solidified thin metal strip by, for example, dripping molten metal on the rapidly rotating water-cooled copper roll. Casting method is a method for forming an ingot by pouring molten metal melted in vacuum or in air into a mold. According to a preferred embodiment of the present invention, the materials obtained by these methods are mechanically segmented (especially into ingot) as needed and pulverized by a ball mill and the like to make fine particles having a particle diameter of 5 μm or less.

EXAMPLES

Example 1

The present invention will be specifically explained based on the examples below.

Figure 3:
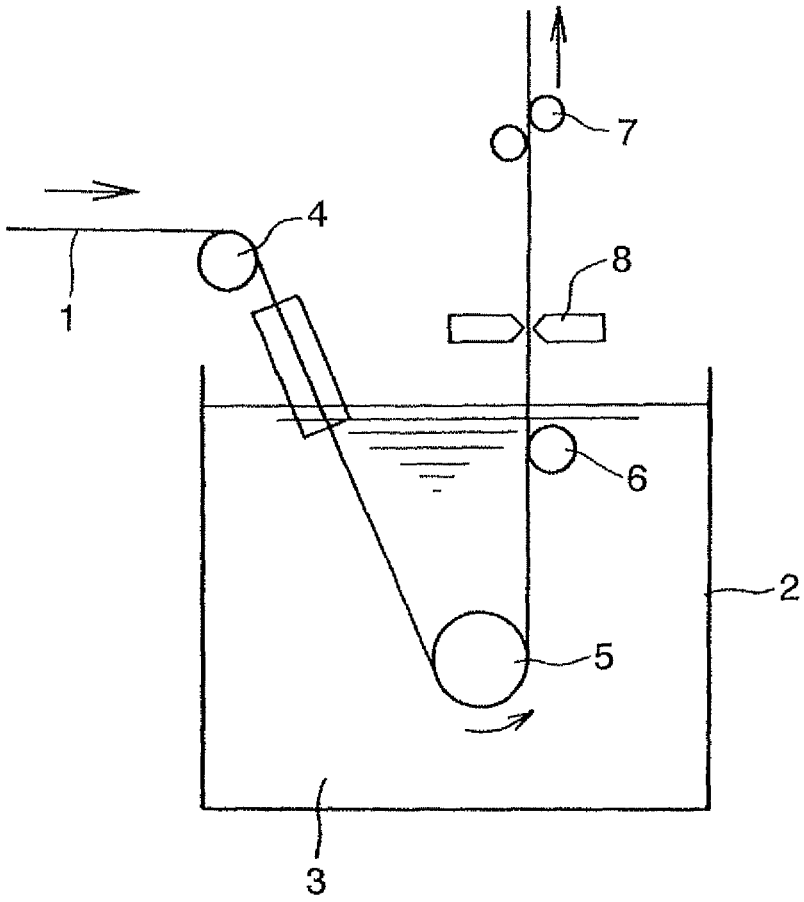
FIG. 3 is a schematic diagram showing the continuous molten zinc galvanization apparatus.

FIG. 3 is a schematic diagram showing the continuous molten zinc galvanizing apparatus. As shown in this figure, steel sheet for zinc galvanization 1 is introduced and immersed into molten zinc bath 3 in galvanizing bath 2 through deflector roll 4 and, after changing direction in the bath by sink roll 5 provided in the central part of galvanizing bath 2, is pulled up from the zinc bath via support roll 7, while contacting with snap roll 6. Injection nozzle 8, provided above the zinc bath, injects inert gas such as nitrogen to the both sides of the galvanized steel sheet to remove the excess molten zinc and control the amount of adherence to the predetermined value. In order to coat the surface of the sink roll (roll material: SUS316), which is an immersion member of the molten zinc galvanizing bath used for such continuous molten zinc galvanizing apparatus, the cermet powder for thermal spraying was prepared by mixing a WC powder and a Co/Ni alloy powder, followed by the granulation step, so that the coated film has the composition shown in Table 1. The thermal spray coated layer was formed by high-velocity flame spraying on the surface of the immersion member of the molten zinc-galvanizing bath using this surface coating material. After that, the thickness of the coated layer was adjusted to 100 μm by polishing treatment.

TABLE 1

| | Film composition | | | Test result | | | | |
|---|---|---|---|---|---|---|---|---|
| | Binder content (%) | | Blend % of binder | Natural immersion potential | Molten zinc corrosion | Compatibility | Overall | |
| No. | Co | Ni | to WC | (mV vs SCE) | Resistance | with WC | evaluation | Remarks |
| 1 | 90 | 10 | 8 | −305 | G | F | G | (1) |
| 2 | 80 | 20 | 15 | −300 | G | G | G | |
| 3 | 75 | 25 | 20 | −298 | G | G | G | |
| 4 | 70 | 30 | 12 | −258 | E | G | E | |
| 5 | 65 | 35 | 15 | −264 | E | G | E | |
| 6 | 60 | 40 | 15 | −270 | E | G | E | |
| 7 | 50 | 50 | 20 | −251 | E | G | E | |
| 8 | 45 | 55 | 12 | −250 | G | G | G | |
| 9 | 40 | 60 | 6 | −260 | G | F | G | |
| 10 | 30 | 70 | 6 | −270 | G | F | G | |
| 11 | 95 | 5 | 20 | −350 | P | G | F | (2) |
| 12 | 93 | 7 | 3 | −306 | F | P | P | |
| 13 | 23 | 77 | 9 | −330 | F | F | F | |
| 14 | 20 | 80 | 35 | −310 | P | G | F | |
| 15 | 15 | 85 | 20 | −330 | P | G | P | |

(Notes)
E: excellent, G: good, F: fair, P: poor
Underlined figures indicate the condition outside of the present invention.
(1) Present invention examples
(2) Comparative examples Natural immersion potential, molten zinc corrosion resistance, compatibility with WC, and hardness were tested for the resultant test pieces.

The test methods are as follows.

(1) Natural Immersion Potential

Electric potential and current were measured with a potentiostat in a 1% by mass sulfuric acid solution at 30° C., using a saturated calomel electrode (SCE) as a reference electrode and a Pt wire as a counter electrode. Based on the graph obtained, the natural immersion potential (my) was calculated by Tafel extrapolation method.

(2) Molten Zinc Corrosion Resistance

The obtained test pieces were immersed in a molten zinc-galvanizing bath (bath composition: 100% Zn, bath temperature 470° C.) for 24 hours. After immersion, the cross-section of the coated layer on the test piece was observed by an optical microscope. In order to evaluate the corrosion resistance of the coated film, a weight reduction rate after molten zinc test was measured by weighing the test piece after removing the adhering zinc by aqueous sodium hydroxide solution and comparing it with the test piece weight before testing. The evaluation criteria of the molten zinc corrosion resistance are as follows.

Excellent: Weight reduction rate is 1.2% or less.
Good: Weight reduction rate is more than 1.2% to 2.2%.
Fair: Weight reduction rate is more than 1.5% to 2.2%
Poor: Weight reduction rate is more than 2.2%.

(3) Compatibility with WC

The Co—Ni alloy powder composed of Co added with Ni was mixed with the WC powder and dispersed, and its compatibility with WC was evaluated under the following criteria.

Good: Co—Ni alloy has a single-phase structure and good compatibility with WC.
Fair: Compatibility with WC is nearly good.
Poor: Compatibility of Co—Ni alloy with WC is poor (presence of holes and the like at the interface is confirmed by electron microscopic observation).

In addition, evaluation of compatibility with WC was performed for the alloy powder by varying the Ni content in the Co-based alloy powder.

As shown in Table 1, No. 1 to 10 are the examples of the present invention and No. 11 to 15 are the comparative examples. In comparative example No. 11, since the amount of Ni added is small, the potential increase effect is insufficient, resulting in poor improvement in zinc corrosion resistance. In comparative example No. 12, although the potential increase effect is observed and the zinc corrosion resistance is improved as a result, the compatibility with WC is insufficient since the blending ratio is small and the overall evaluation is insufficient. In comparative example No. 13, since the amount of Ni added is excessive, the potential increase effect and zinc corrosion resistance are rather degraded.

In comparative example No. 14, in which the components are almost the same as No. 13, since the ratio of the alloy to WC is excessive, the potential increase effect is further small. In comparative example No. 15, the amount of Ni added is excessive and the potential increase effect and the zinc corrosion resistance are degraded. Thus, the improvement effect compared with the conventional Co binder was not observed outside the scope of the present invention. To the contrary, it was found that all of the examples No. 1 to 10 of the present invention provided good results since all of them satisfied the condition of the present invention.

Example 2

Similarly to Example 1, natural immersion potential, molten zinc corrosion resistance, compatibility with WC and judgment of single structure, and hardness were tested for the obtained test pieces. The results are shown in Table 2. Note that the test method for the compatibility with WC and judgment of single structure is as follows.

Compatibility with WC and Judgment of Single Composition

For testing the compatibility with WC, thermal spraying was performed using the thermal spray powder, which was obtained by mixing a WC powder with an alloy powder of Co and one or more of Ni, Al, Si, Mo, Nb, Cr, W, and Ta, in which one or more of Ni, Al, Si, Mo, Nb, Cr, W, and Ta was added to Co, and granulating. Cross-section of the test pieces having the corresponding thermal spray layer was observed by a metal microscope. The evaluation criteria from the observation are as follows.

Good: Alloy of Co and one or more of Ni, Al, Si, Mo, Nb, Cr, W, and Ta has a single-phase structure and good compatibility with WC.

Fair: Compatibility with WC is nearly good.

Poor: Compatibility of alloy of Co and one or more species of Ni, Al, Si, Mo, Nb, Cr, W, and Ta and WC is poor (Holes and the like are found to be present at the interface of WC and the binder metal by metal microscopic observation of the structure.)

Note that the evaluation of the compatibility with WC was performed for the alloy powder by varying the content of one or more of Ni, Al, Si, Mo, Nb, Cr, W, and Ta in the alloy powder containing Co.

TABLE 2

| | Film composition | | | | | | | | | | | |
|---|---|---|---|---|---|---|---|---|---|---|---|---|
| | Binder content (%) | | | | | | | | | | immersion potential nobler than | Blending % of binder |
| No. | Co | Ni | Al | Si | Mo | Nb | Cr | W | Ta | Structure | Co (mV) | to WC |
| 1 | 80 | 20 | | | | | | | | single(1) | 60 | 8 |
| 2 | 70 | 30 | | | | | | | | single | 102 | 15 |
| 3 | 50 | 50 | | | | | | | | single | 109 | 20 |
| 4 | 30 | 70 | | | | | | | | single | 91 | 7 |
| 5 | 77 | | 23 | | | | | | | single | 84 | 15 |
| 6 | 97 | | | 3 | | | | | | single | 74 | 15 |
| 7 | 96 | | | | 4 | | | | | single | 63 | 20 |
| 8 | 99.5 | | | | | 0.5 | | | | single | 52 | 12 |
| 9 | 96 | | | | | | 4 | | | single | 58 | 11 |
| 10 | 92 | | | | | | 8 | | | single | 73 | 9 |
| 11 | 95 | | | | | | | 5 | | single | 61 | 15 |
| 12 | 98 | | | | | | | | 2 | single | 55 | 8 |
| 13 | 92 | 8 | | | | | | | | single | 10 | 20 |
| 14 | 24 | 76 | | | | | | | | single | 42 | 6 |
| 15 | 80 | | 20 | | | | | | | biphasic | 29 | 9 |
| 16 | 60 | | 40 | | | | | | | biphasic | 16 | 15 |
| 17 | 99.9 | | | 0.1 | | | | | | single | 5 | 20 |
| 18 | 93 | | | 7.0 | | | | | | biphasic | 38 | 6 |
| 19 | 99.9 | | | | 0.1 | | | | | single | 6 | 15 |
| 20 | 84 | | | | 16 | | | | | biphasic | 38 | 15 |
| 21 | 99.9 | | | | | 0.1 | | | | single | 6 | 20 |
| 22 | 98.4 | | | | | 1.6 | | | | biphasic | 26 | 12 |
| 23 | 99.9 | | | | | | 0.1 | | | single | 4 | 10 |
| 24 | 88 | | | | | | 12 | | | biphasic | 41 | 5 |
| 25 | 99.9 | | | | | | | 0.1 | | single | 2 | 12 |
| 26 | 75 | | | | | | | 25 | | biphasic | 11 | 12 |
| 27 | 99.9 | | | | | | | | 0.1 | single | 1 | 15 |
| 28 | 92 | | | | | | | | 8 | biphasic | −6 | 15 |

| | Test result | | | |
|---|---|---|---|---|
| No. | Natural immersion potential (mV vs SCE) | Molten zinc corrosion Resistance | Compatibility with WC | Overall evaluation |
| 1 | −300 | G | F | G |
| 2 | −258 | E | G | E |
| 3 | −251 | E | G | E |
| 4 | −269 | E | G | E |
| 5 | −276 | E | G | E |
| 6 | −286 | E | G | E |
| 7 | −297 | E | G | E |
| 8 | −308 | G | G | G |
| 9 | −302 | E | G | E |
| 10 | −287 | E | G | E |
| 11 | −304 | E | G | E |
| 12 | −307 | G | G | G |

TABLE 2-continued

| | | | | |
|---|---|---|---|---|
| 13 | −350 | P | G | P |
| 14 | −318 | F | F | F |
| 15 | −331 | F | P | F |
| 16 | −344 | P | P | F |
| 17 | −355 | P | G | P |
| 18 | −322 | F | P | P |
| 19 | −354 | P | G | F |
| 20 | −322 | F | P | P |
| 21 | −354 | P | G | F |
| 22 | −334 | F | P | P |
| 23 | −356 | F | G | F |
| 24 | −319 | P | F | P |
| 25 | −358 | F | G | F |
| 26 | −349 | F | G | F |
| 27 | −357 | F | G | F |
| 28 | −366 | P | F | P |

(Notes)
E: excellent, G: good, F: fair, P: poor
Underlined figures indicate the condition outside of the present invention.
(1)single = single phase As shown in Table 2, No. 1 to 12 are the examples of the present invention and No. 13 to 28 are the comparative examples.

In comparative example No. 13, although the binder metal has a single-phase structure, since the amount of Ni added is small, the immersion potential is less than 50 mV nobler than Co and the potential increase effect is insufficient, resulting in poor improvement in zinc corrosion resistance. In comparative example No. 14, since the amount of Ni added is excessive and the potential is much nearer to Ni than Co base, the immersion potential is less than 50 mV nobler than Co and the potential increase effect is insufficient, resulting in rather degraded zinc corrosion resistance.

In comparative example No. 15, since the amount of Al added is small, a biphasic structure is formed and an electrochemical phenomenon by a local cell occurs. Therefore, the immersion potential is less than 50 mV nobler than Co and the potential increase effect is insufficient, resulting in poor improvement in zinc corrosion resistance. In No 16, since the amount of Al added is excessive and biphasic structure is formed, the immersion potential is less than 50 mV nobler than Co and the potential increase effect is insufficient, resulting in poor improvement in zinc corrosion resistance. In No. 17, since the amount of Si added is small, the immersion potential is less than 50 mV nobler than Co and the potential increase effect is insufficient, resulting in poor improvement in zinc corrosion resistance.

In No. 18, since the amount of Si added is excessive and a biphasic structure is formed, the immersion potential is less than 50 mV nobler than Co and the potential increase effect is insufficient, resulting in poor improvement in zinc corrosion resistance. In addition, since the binder metal is hardened by excessive addition of Si, compatibility with WC is poor. In No. 19, since the amount of Mo added is small, the immersion potential is less than 50 mV nobler than Co and the potential increase effect is insufficient, resulting in poor improvement in zinc corrosion resistance. In No. 20, since the amount of Mo added is excessive and a biphasic structure is formed, the immersion potential is less than 50 mV nobler than Co and the potential increase effect is insufficient, resulting in poor improvement in zinc corrosion resistance.

In No. 21, since the amount of Nb added is small, the potential increase effect was insufficient, resulting in poor improvement in zinc corrosion resistance. In No. 22, since the amount of Nb added is excessive and a biphasic structure is formed, the immersion potential is less than 50 mV nobler than Co and the potential increase effect is insufficient, resulting in poor improvement in zinc corrosion resistance. In No. 23, since the amount of Cr added is small, the immersion potential is less than 50 mV nobler than Co and the potential increase effect is insufficient, resulting in poor improvement in zinc corrosion resistance.

In No. 24, since the amount of Cr added is excessive and a biphasic structure is formed, the local cell action occurs and the potential increase effect is insufficient, resulting in poor improvement in zinc corrosion resistance. In No. 25, since the amount of W added is small, the immersion potential is less than 50 mV nobler than Co and the potential increase effect is insufficient, resulting in poor improvement in zinc corrosion resistance. In No. 26, since the amount of W added is excessive and a biphasic structure is formed, the local cell action occurs and the potential increase effect is insufficient, resulting in poor improvement in zinc corrosion resistance.

In No. 27, since the amount of Ta added is small, the immersion potential is less than 50 mV nobler than Co and the potential increase effect is insufficient, resulting in poor improvement in zinc corrosion resistance. In No. 28, since the amount of Ta added is excessive and a biphasic structure is formed, the local cell action occurs and the potential increase effect is insufficient, resulting in poor improvement in zinc corrosion resistance. Thus, the improvement effect compared with the conventional Co binder was not observed outside the scope of the present invention. To the contrary, it was found that all of the examples No. 1 to 12 of the present invention provided good results since all of them satisfied the condition of the present invention.

The invention claimed is:

1. A surface coating material for forming a coated layer on a surface of a molten zinc bath member, wherein the surface coating material consists of WC powder particles and a binder metal, wherein a blending ratio of the binder metal to the WC powder particles is 5 to 25% by mass, wherein the binder metal constitutes an alloy structure having a single phase, wherein the binder metal is an alloy comprising Co and one or more of Ni, Al, Si, Mo, Nb, Cr, W and Ta, wherein the binder metal comprises one or more of 10 to 75% by mass of Ni, 23 to 35% by mass of Al, 0.2 to 6.0% by mass of Si, 0.2 to 15% by mass of Mo, 0.2 to 11% by mass of Nb, 0.2 to 8% by mass of Cr, 0.2 to 10% by mass of W, and 0.2 to 5% by mass of Ta relative to the total amount of the binder metal in addition to Co, wherein the binder metal is provided in a form of an alloy powder containing 10 to 75% by mass of Ni relative to the total amount of the binder metal in addition to Co, and the alloy powder is mixed with WC powder and granulated to a powder having a particle diameter of 5 μm or more and 75 μm or less, and wherein the binder alloy is a Co base alloy.

2. The surface coating material according to claim 1, wherein the binder metal has an immersion potential nobler than Co by 50 mV or more in aqueous environment or molten metal environment.

3. The surface coating material according to claim 1, wherein the coated layer is formed on a circumferential surface using the surface coating powder and has a thickness of 20 μm or more and 1200 μm or less.

4. A surface-coated molten zinc bath member comprising:

a molten zinc bath member; and a coated layer provided on a surface of the molten zinc bath member, the coated layer being made of the surface coating material according to claim 1.

5. A method for producing a surface coating material for forming a coated layer on a surface of a molten zinc bath member comprising the steps of:

producing an alloy powder comprising one or more of 10 to 75% by mass of Ni, 23 to 35% by mass of Al, 0.2 to 6.0% by mass of Si, 0.2 to 15% by mass of Mo, 0.2 to 11% by mass of Nb, 0.2 to 8% by mass of Cr, 0.2 to 10% by mass of W, and 0.2 to 5% by mass of Ta relative to the total amount of the alloy powder in addition to Co, by an atomization method or by a method of pulverizing a quenched thin strip or an alloy in a thin-strip or mass form obtained by casting, wherein the alloy powder is a Co base alloy;

mixing the alloypowder with a WC powder to form a mixed powder, wherein a blending ratio of the alloy powder to the WC powder particles is 5 to 25% by mass; and granulating the mixed powder to obtain the surface coating material, wherein the surface coating material consists of the WC powder particles and the alloy powder, and wherein the alloy powder contains 10 to 75% by mass of Ni relative to the total amount of the binder metal in addition to Co and the granulation is performed to provide the mixed powder with a particle diameter of 5 μm or more and 75 μm or less.

6. A method for producing a molten zinc bath member, comprising thermal spraying the surface of the molten zinc bath member with the surface coating material according to claim 1 to obtain a surface-coated molten zinc bath member.

* * * * *